US008766125B2

(12) United States Patent
Chou et al.

(10) Patent No.: US 8,766,125 B2
(45) Date of Patent: Jul. 1, 2014

(54) PRESSURE KEY

(71) Applicant: Universal Cement Corporation, Taipei (TW)

(72) Inventors: Chia-Hung Chou, Taipei (TW); Chih-Sheng Hou, Taipei (TW)

(73) Assignee: Universal Cement Corporation, Taipei (TW)

( * ) Notice: Subject to any disclaimer, the term of this patent is extended or adjusted under 35 U.S.C. 154(b) by 42 days.

(21) Appl. No.: 13/673,274

(22) Filed: Nov. 9, 2012

(65) Prior Publication Data

US 2014/0131186 A1 May 15, 2014

(51) Int. Cl.
*H01H 1/10* (2006.01)

(52) U.S. Cl.
USPC ..... 200/512

(58) Field of Classification Search
CPC ..... H01H 13/785; H01H 2201/02; H01H 2231/016; H01H 13/12; H01H 13/52; H01H 13/70; H01H 59/0009; H01H 57/00; H01H 1/20
USPC ..... 200/181, 534, 520, 510, 51.16, 333, 200/341, 512; 310/311, 314, 319
See application file for complete search history.

(56) References Cited

U.S. PATENT DOCUMENTS

| | | | | |
|---|---|---|---|---|
| 6,157,323 | A * | 12/2000 | Tso et al. | 341/22 |
| 7,271,361 | B2 * | 9/2007 | Sugimura et al. | 200/341 |
| 8,124,897 | B2 * | 2/2012 | Bollmann et al. | 200/310 |
| 2010/0148999 | A1 | 6/2010 | Casparian et al. | |

* cited by examiner

*Primary Examiner* — Edwin A. Leon
(74) *Attorney, Agent, or Firm* — Lowe Hauptman & Ham, LLP

(57) ABSTRACT

A D/A integrated pressure key for a keyboard is shown. A digital signal output first when a pressure is applied on the single key, and then an analog signal output while applying a bigger pressure over the same key. The magnitude of the analog signal output is positively related to the magnitude of the pressure applied on the integrated pressure key.

24 Claims, 16 Drawing Sheets

PRESSURE KEY

BACKGROUND

1. Technical Field

The present invention relates to a pressure key used in a keyboard, especially a digital/analog integrated pressure key which is capable of being able to output a digital signal first, and then output an analog signal while maintaining the digital signal on.

2. Description of Related Art

FIG. 1 is a prior art

FIG. 1 is a two-pressure-key system disclosed in US2010/0148999 which is used in a keyboard for outputting a digital signal and an analog signal. It discloses an analog key 202 and a digital key 203. In operation, depressing the analog key cap 202 shall cause an analog signal output 220, and depressing digital key cap 203 shall cause a digital or on/off output 222. The analog key provides a variable output, and the digital key provides a momentary-on output. A plastic base 212 supports the key structure. A flexible PCB (printed circuit board) 210 is provided on top of the base 212. The PCB 210 includes circuit traces or connections that provide for electrical signals to be generated and communicated when keys are depressed. Circuit connection 236 is used to provide digital output 222, and circuit connection pads 230 and 231 are used to provide the analog output 220. The next layer is flexible insulator 208, such as a flexible PCB without circuit connections. The next layer is another flexible PCB206 that includes circuit traces or connections that work in conjunction with the connections on PCB 210 to provide for electrical signals to be generated and communicated when keys are depressed.

A relatively thin flexible layer 204 is provided above PCB 206. A flexible dome 215 is provided for analog key cap 202, and flexible dome 213 is provided for digital key cap 203. For the digital key, an actuator 214 is provided underneath the dome 213 that causes circuit trace 234 to be engaged with circuit trace 236 when the digital key cap 203 is depressed. When circuit trace 234 touches the circuit trace 236, a digital output 222 is provided. For the analog key, a conductive and flexible half-dome 216 is provided that flexes when depressed. The capacitance associated between circuit pad 231 and circuit pad 230 varies when analog key cap 202 is depressed. Essentially pad 231 and pad 230 are the two plates of a capacitor. The variable capacitance between these two plates is measured from signal trace 232 by sending this trace to capacitance reading circuitry.

The separate key system is not an easy controlling device for a game player. A favorable controlling device for outputting a digital signal and an analog signal device needs to be devised.

BRIEF DESCRIPTION OF THE DRAWINGS

FIGS. 2A~12B are section views of the second rubber dome button according to the present invention.

DETAILED DESCRIPTION OF THE INVENTION

This invention discloses a D/A integrated pressure key which is able to output a digital signal and analog signal in the course of depressing the single pressure key to the bottom.

Figure 1:
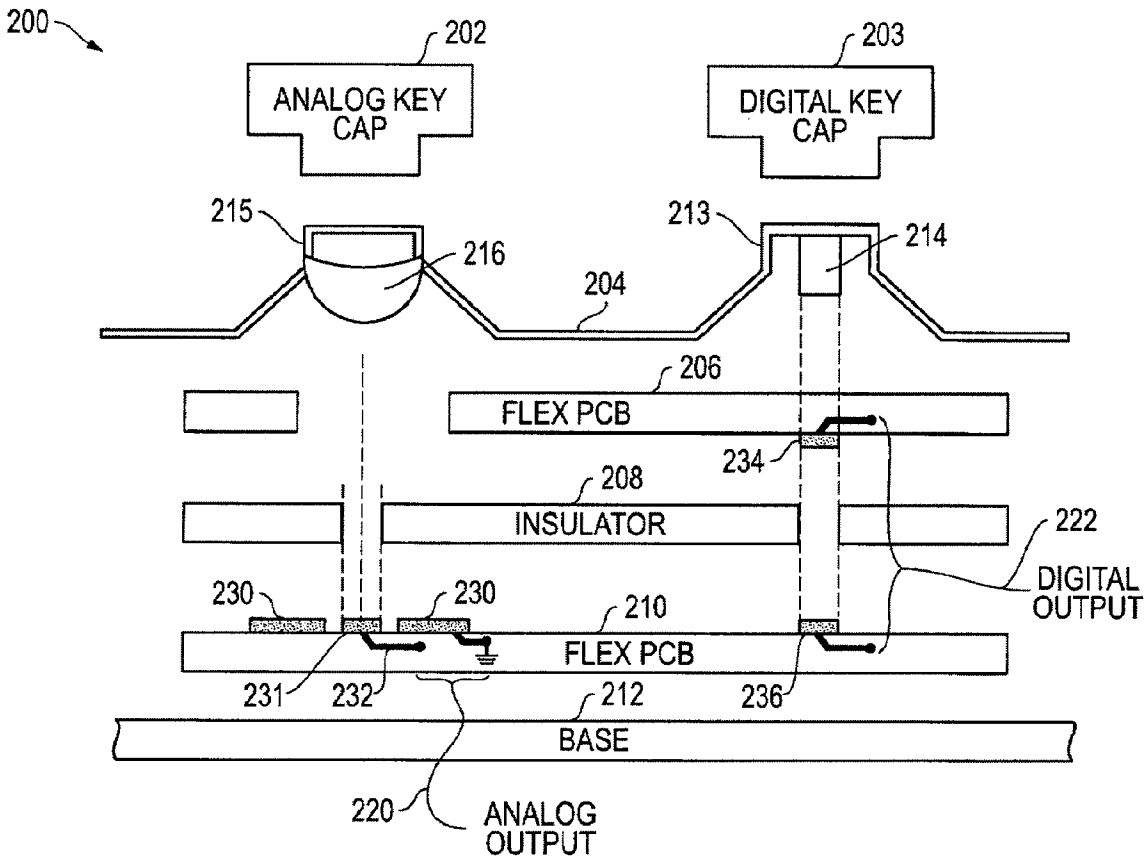
Fig. 1. Prior Art
FIG. 1 is a prior art.
Figure 2:
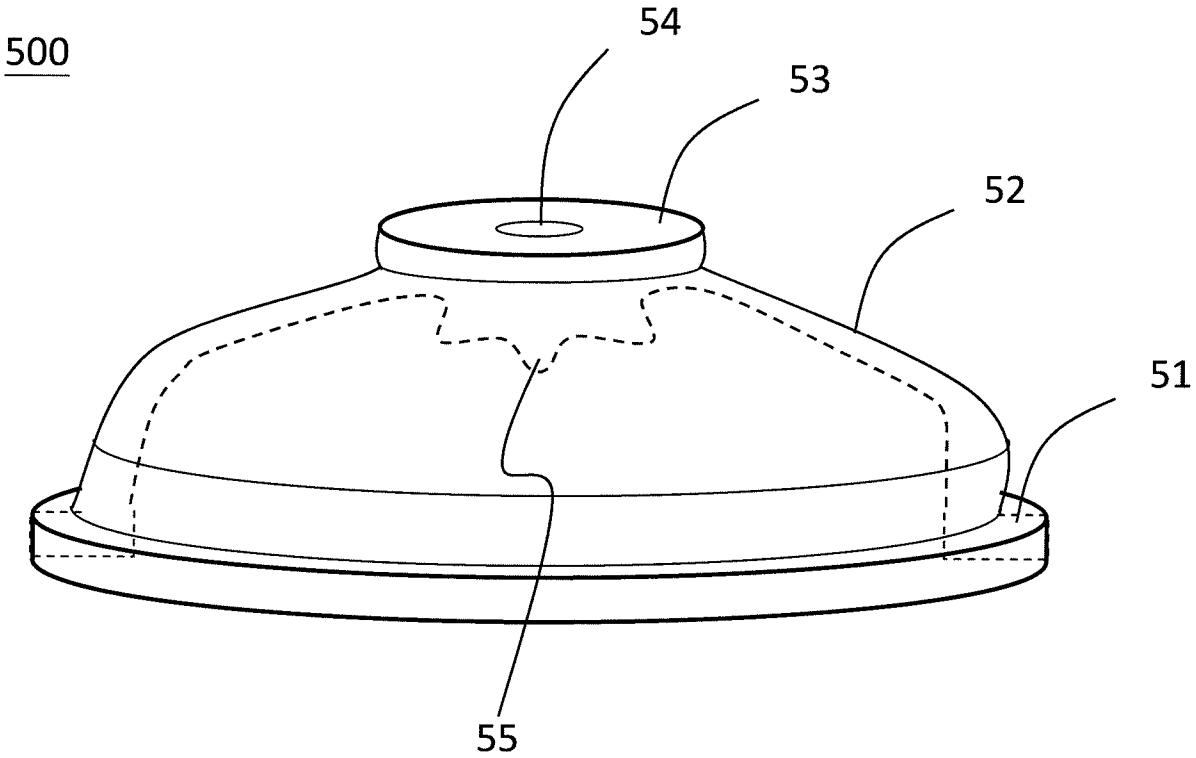
FIG. 2 is a first rubber dome button according to the present invention.

FIG. 2 is a first rubber dome button according to the present invention.

FIG. 2 shows a rubber dome button 500 which can be used in the present invention, has a base rubber ring 51 on a bottom; a dome 52 is configured on a top of the base rubber ring 51; a central button 53 is configured on a top center of the dome 52; a downward central bump 55 is configured under a bottom center of the rubber button 53. A central recess 54 can be made in the top center of the rubber button 53.

Figure 3:
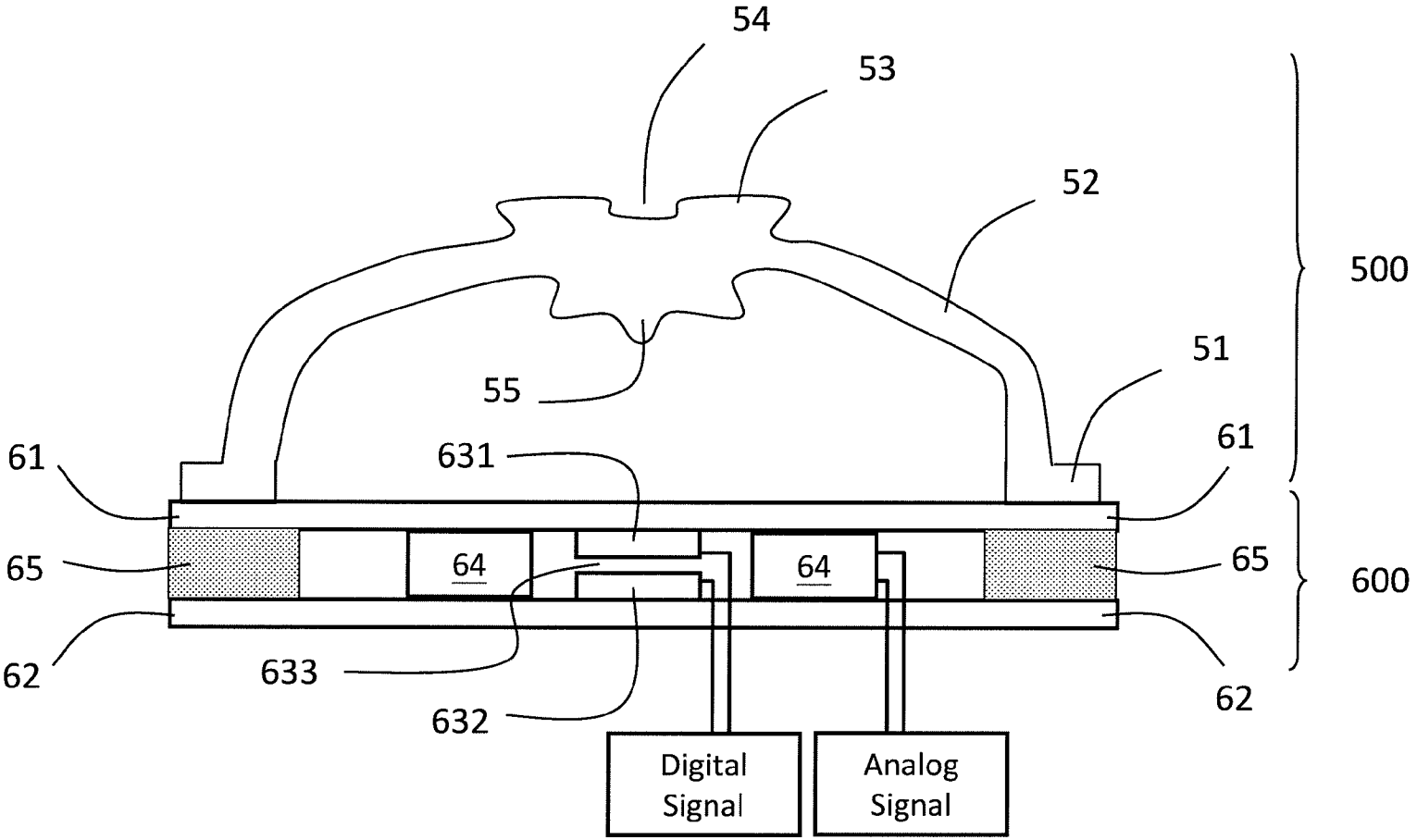
FIG. 3 is a first embodiment according to the present invention.

FIG. 3 is a first embodiment according to the present invention.

A circuit base 600 is configured on a bottom of the rubber dome button 500. The circuit base 600 has a top substrate 61 and a bottom substrate 62; a top electrode 631 is configured under a bottom surface of the top substrate 61; a bottom electrode 632, aligned with the top electrode 631, is configured on a top surface of the bottom substrate 62; a gap 633 is configured between the top electrode 631 and the bottom contact 632; a pressure sensor ring 64, configured between the top substrate 61 and the bottom substrate 63, is configured concentrically with the top electrode 631. The top substrate 61 is flexible; when the top substrate 61 is depressed to cause the top electrode 631 contacting the bottom electrode 632, a digital signal shall output; and when the top substrate 61 is depressed against the pressure sensor ring 64, an analog signal shall output. A hard spacer ring 65, aligned with the base rubber ring 51, is configured concentrically with the top electrode 631, and is configured between the top substrate 61 and the bottom substrate 62 to function as a pressure-resistant block against the pressure from the base rubber ring 51 when a pressure is applied on the rubber dome button 500.

With the rubber dome button 500 configured on a top surface of the circuit base 600, when the rubber button 53 is restorably depressed, the downward central bump 55 is restorably depressed to apply a first pressure on the top substrate 61 against the top electrode 631; and a downward crack bump ring 56 is formed temporarily and configured concentrically with the downward central bump 55 when the central button 53 is depressed to a degree; wherein a bottom tip of the downward crack bump ring 56 initially having a position above a bottom tip of the downward central bump 55; the downward crack bump ring 56 is able to apply a second pressure on the top substrate 61 against the pressure sensor ring 64 when the central button 53 is depressed further.

Figure 4:
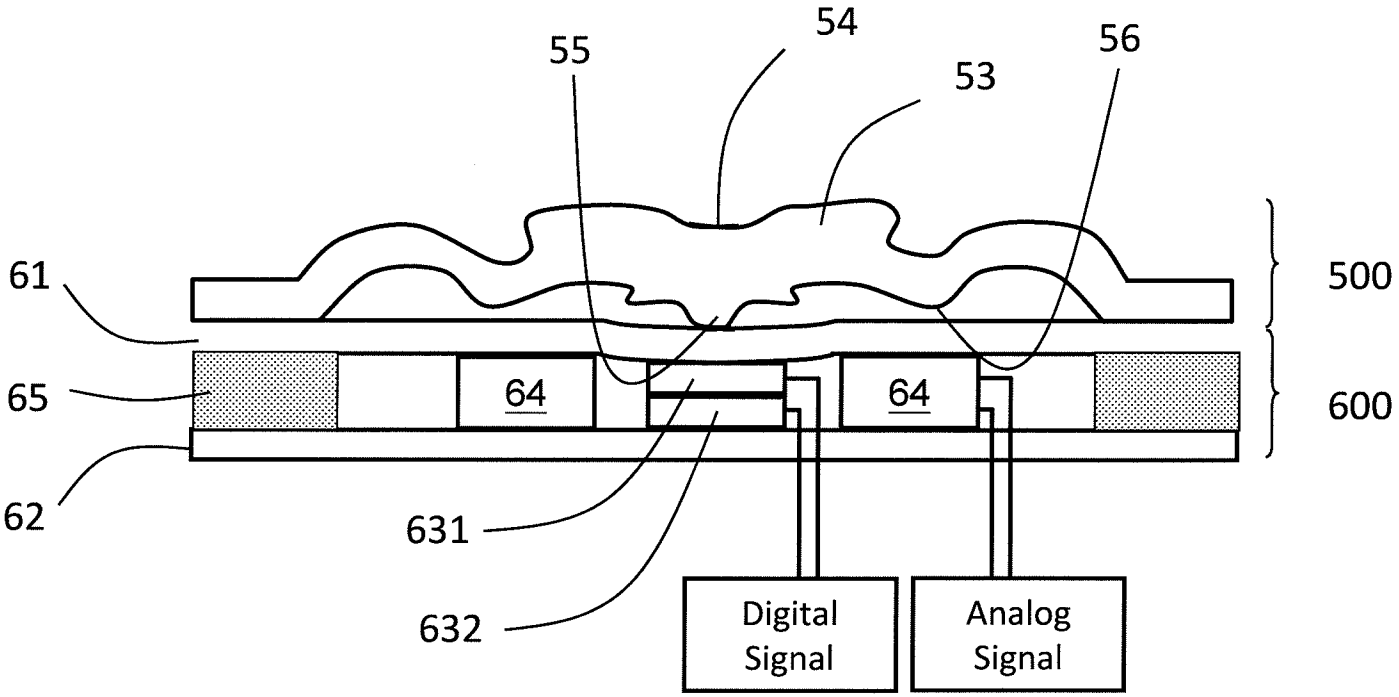
FIG. 4 shows digital signal output according to the present invention

FIG. 4 shows digital signal output according to the present invention

FIG. 4 shows when the downward central bump 55 applies a first pressure on the top substrate 61 against the top electrode 631 to cause the top electrode 631 contacting the bottom electrode 632, a digital signal shall output. At this moment, no pressure is applied against the pressure sensor ring 64, no analog signal shall output.

Figure 5:
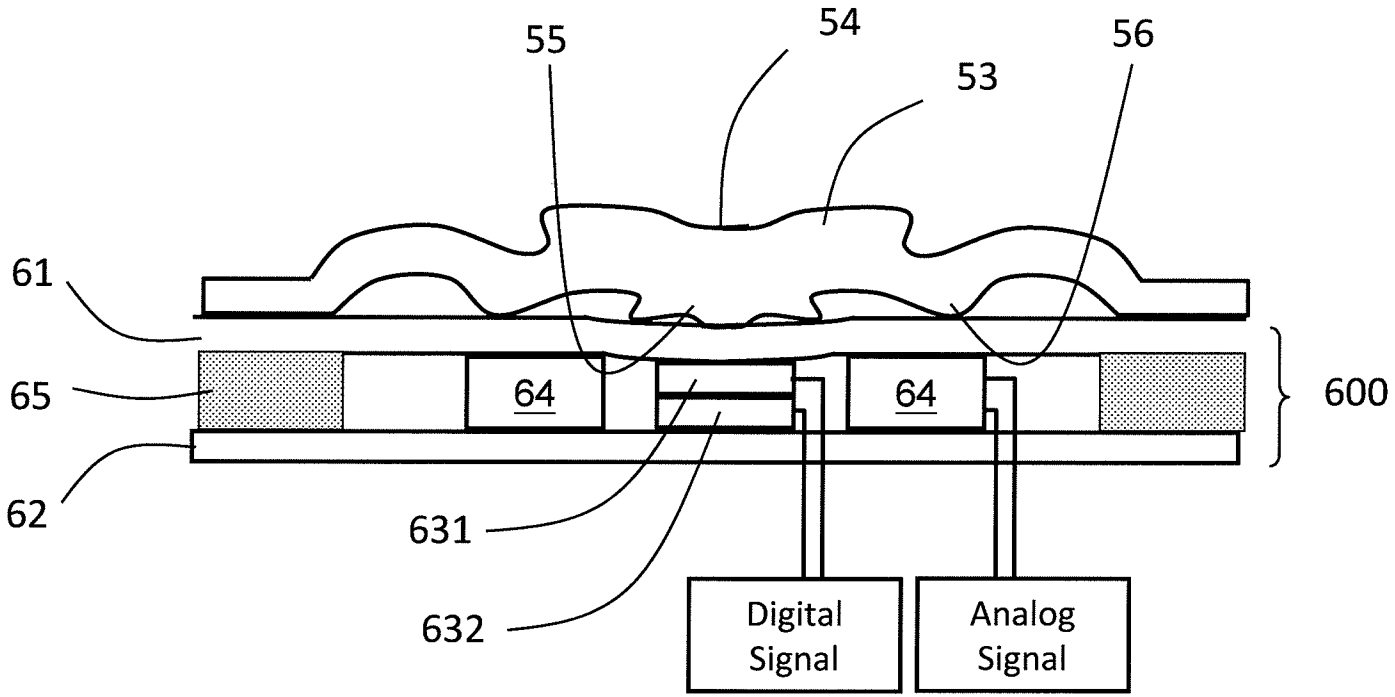
FIGS. 5~7 show analog signal output according to the present invention
Figure 6:
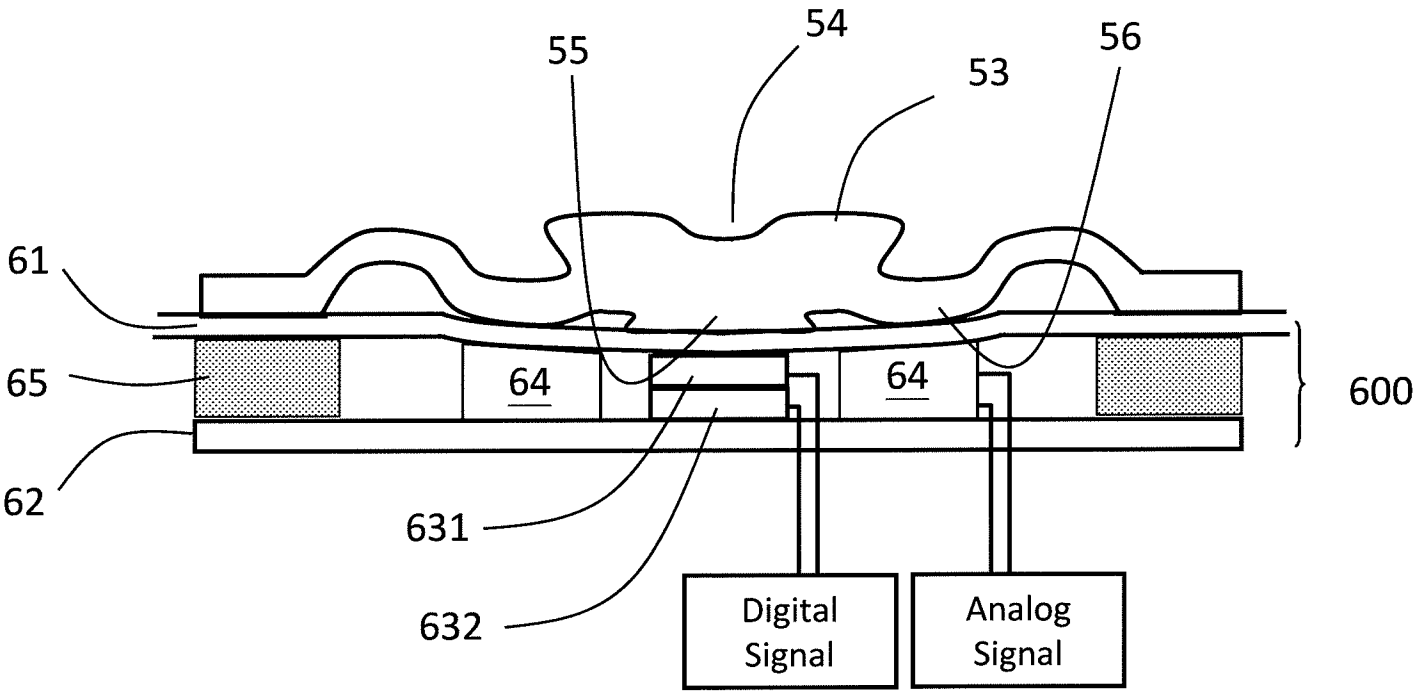
Figure 7:
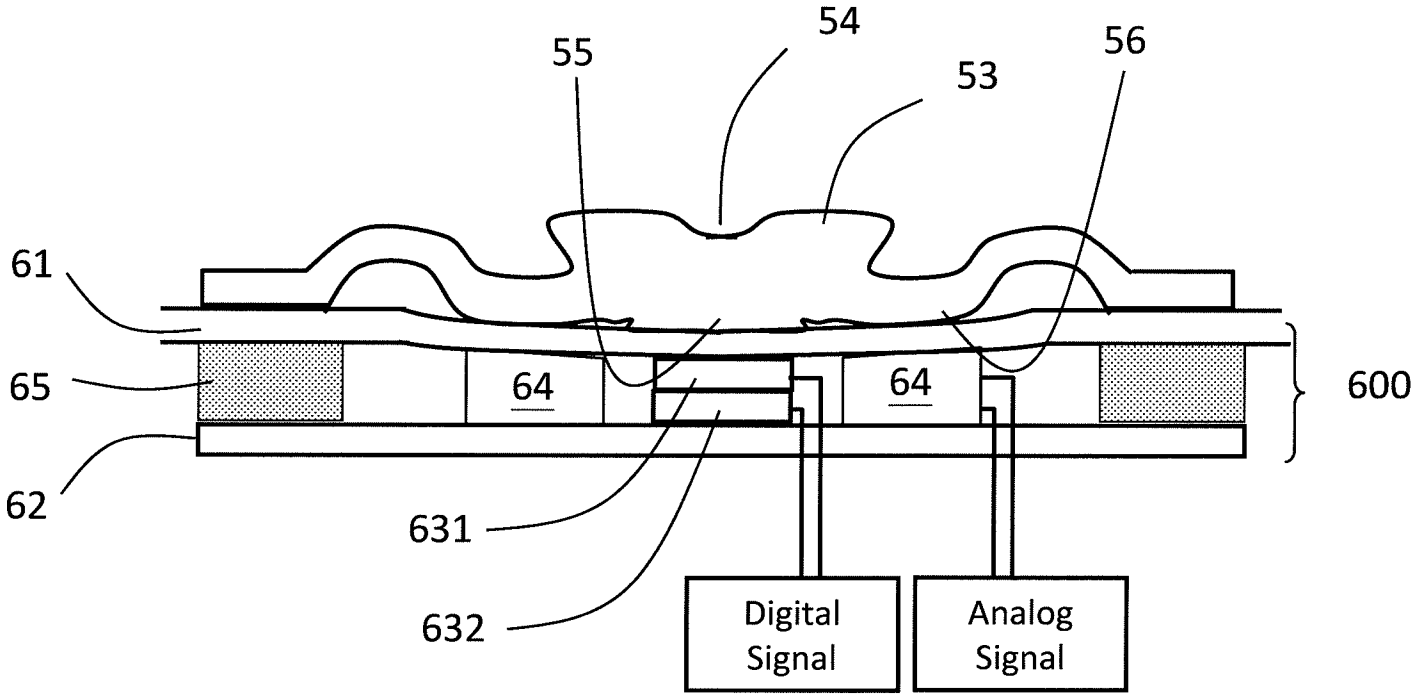

FIGS. 5~7 show analog signal output according to the present invention

FIG. 5 shows after the first pressure is applied, and if the central button 53 is depressed further, the downward crack bump ring 56 shall apply a second pressure on the top substrate 61 against the pressure sensor ring 64 to cause an analog signal to output. FIG. 6 shows that a stronger analog signal outputs, the magnitude of the analog signal output is positively related to the magnitude of the pressure applied against the pressure sensor ring 64. The pressure comes from the depressed downward crack bump ring 56. FIG. 7 shows that an even stronger analog signal outputs which is positively related to an even bigger pressure applied against the pressure sensor ring 64.

Figures 8A, 8B:
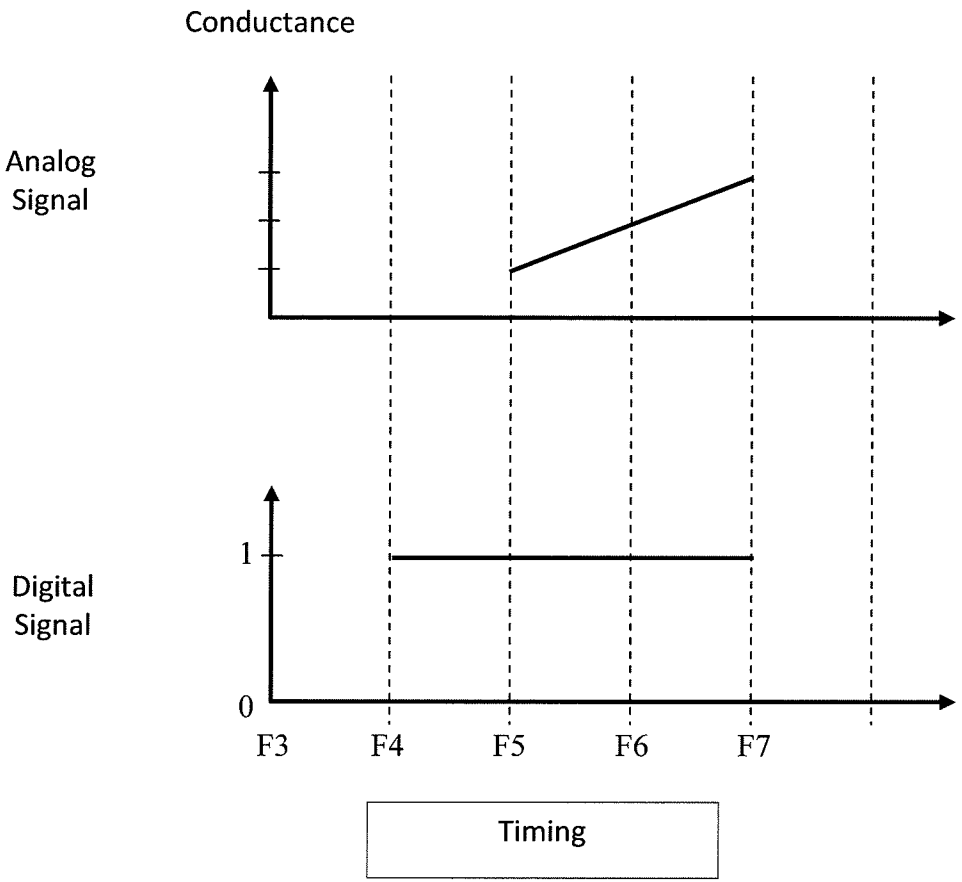
FIGS. 8A~8B show the timing of digital signal and analog signal according to the present invention

FIGS. 8A~8B show the timing of digital signal and analog signal according to the present invention FIG. 8A shows Analog Signal versus Timing. The Analog Signal is arranged on the Y-coordinate with scales of Conductance, and the Timing is arranged on the X-coordinate with scales F3, F4, F5, F6, and F7 each corresponding to a status of FIG. 3, FIG. 4, FIG. 5, FIG. 6 and FIG. 7.

FIG. 8B shows Digital Signal versus Timing. The Digital Signal is arranged on the Y-coordinate with scales of 1 and 0 which represents on and off respectively, and the Timing is arranged on the X-coordinate with scales F3~F7 each corresponding to a status of FIG. 3~FIG. 7.

The analog signal occurs at F5, F6, and F7. Please refer to a status of FIG. 5 for timing F5. Please refer to a status of FIG. 6 for timing F6. Please refer to a status of FIG. 7 for timing F7. At timing F3, neither digital signal or analog signal outputs. At timing F4, a digital signal 1 outputs. At timing F5, an analog signal occurs while the digital signal 1 continues. At timing F6, a bigger analog signal occurs while the digital signal 1 continues. At timing F7, an even bigger analog signal occurs while the digital signal 1 continues.

Figures 9A, 9B:
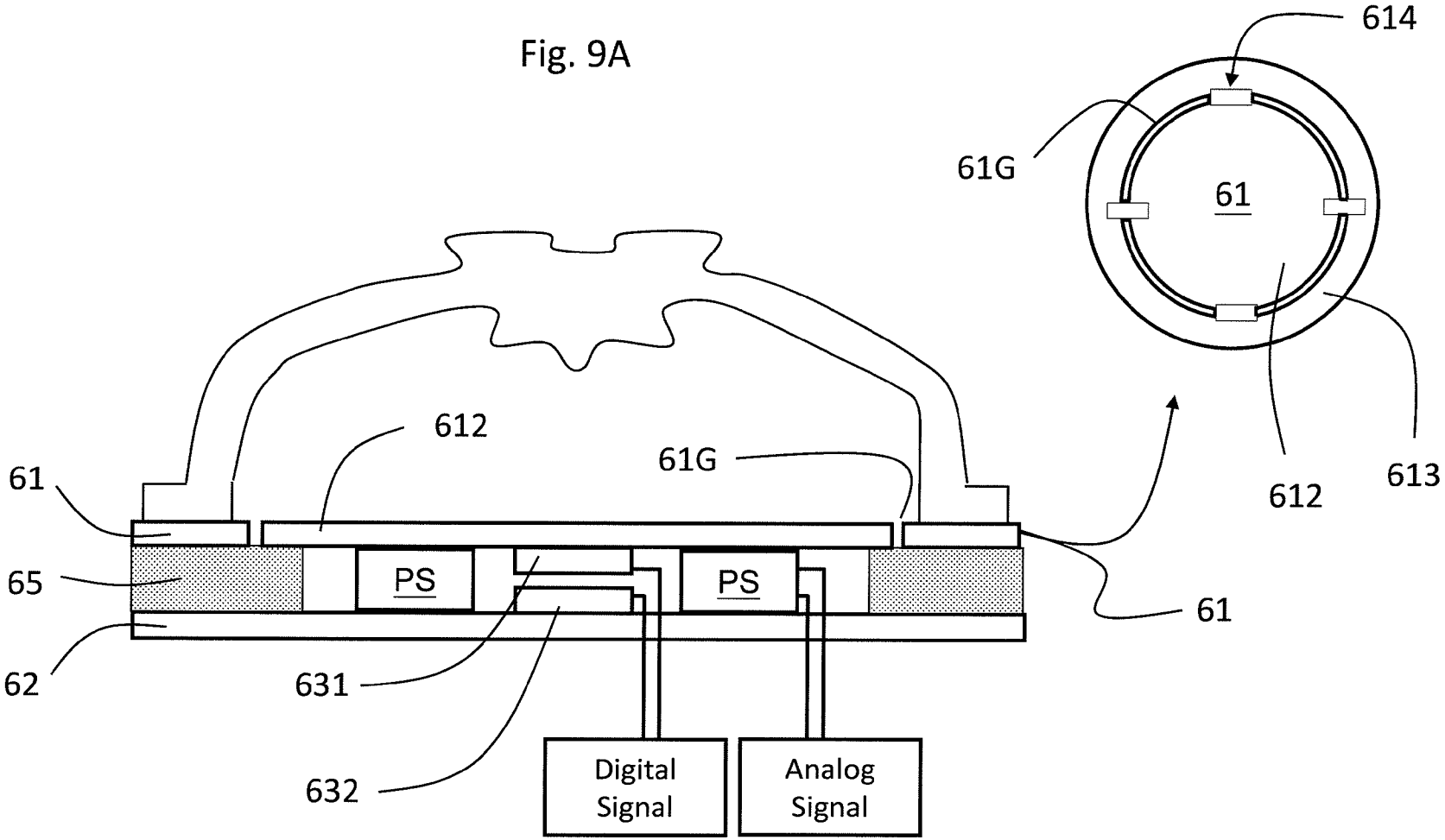
FIGS. 9A~9B show a modified circuit base according to the present invention

FIGS. 9A~9B show a modified circuit base according to the present invention FIG. 9A shows gaps 61G are formed in the top substrate 61; gaps 61 are configured in a position above the spacer ring 65, and are configured along an inner side of the spacer ring 65. The gap 61G is provided to release a centripetal tension while the downward central bump 55 and/or the downward crack bump ring 56 is depressed against the top substrate 61 so that the downward crack bump ring 56 can be fully depressed against the top substrate 61. FIG. 9B shows a top view of the top substrate 61, where the configuration of gaps 61G, the inner portion 612, and the outer portion 613 are shown. Four quarter gaps are shown in FIG. 9B for an example, less number or more number of the gaps can be optionally adopted. The four quarter arc gaps 61G of FIG. 9B are formed in the top substrate 61, and are configured in a position above the spacer ring 65, and are configured along an inner side of the spacer ring 65.

Figure 10C:
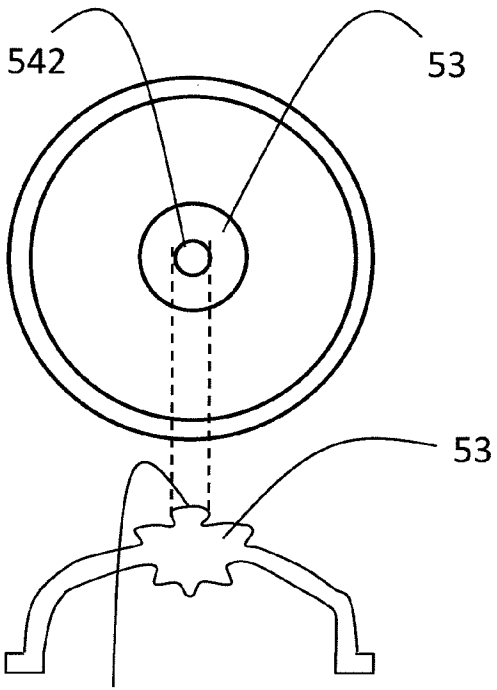
FIGS. 10A~10C show top views of different rubber dome button according to the present invention
Figure 10B:
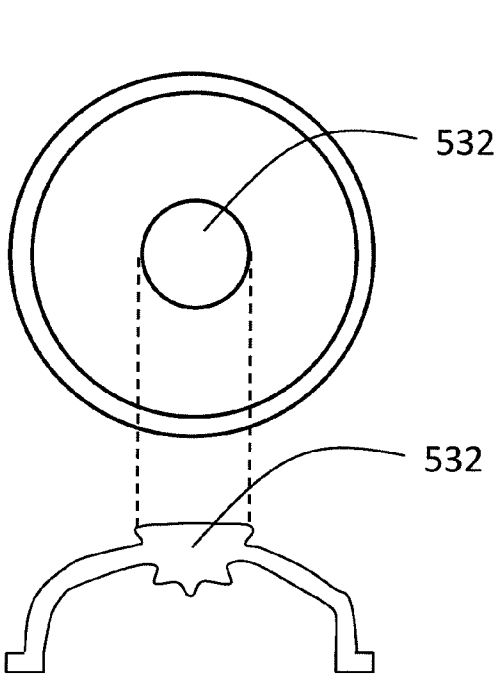
Figure 10A:
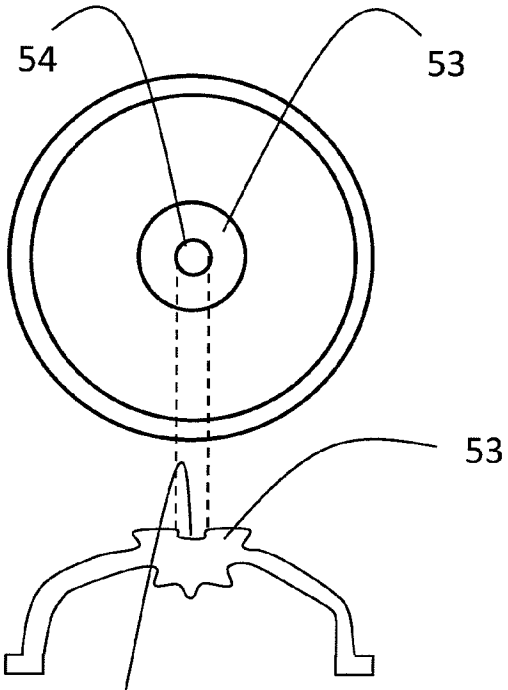

FIGS. 10A~10C show top views of different rubber dome button according to the present invention Top view of different designs for the rubber dome button 500 are shown in FIGS. 10A~10C. FIG. 10A shows that a recess 54 is configured on a top center of the central button 53. FIG. 10B shows that a flat surface is made on a top surface of the central button 532. FIG. 10C shows that an upward central bump 542 is configured on a top center of the central button 53.

Figure 10F:
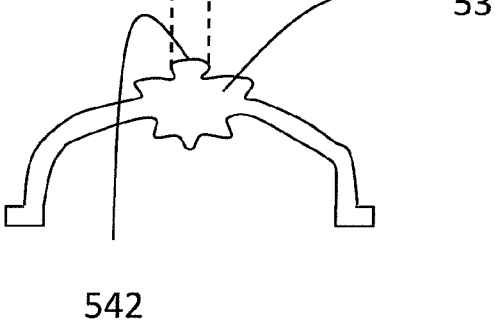
FIGS. 10D~10F show section views of the rubber dome button of FIGS. 10A~10C.
Figure 10E:
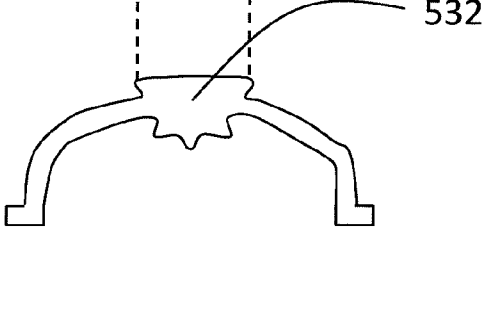
Figure 10D:
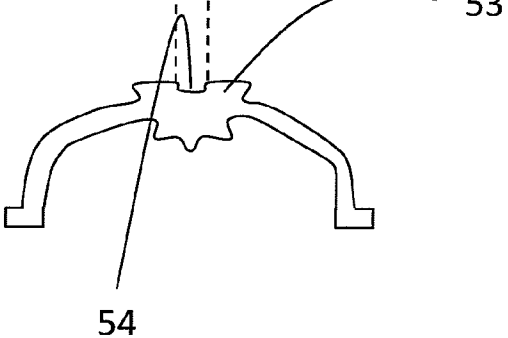

FIGS. 10D~10F show section views of the rubber dome button of FIGS. 10A~10C. FIG. 10D shows that a recess 54 is configured on a top center of the central button 53. FIG. 10E shows that a flat surface is made on a top surface of the central button 532. FIG. 10F shows that an upward central bump 542 is configured on a top center of the central button 53.

Figure 11:
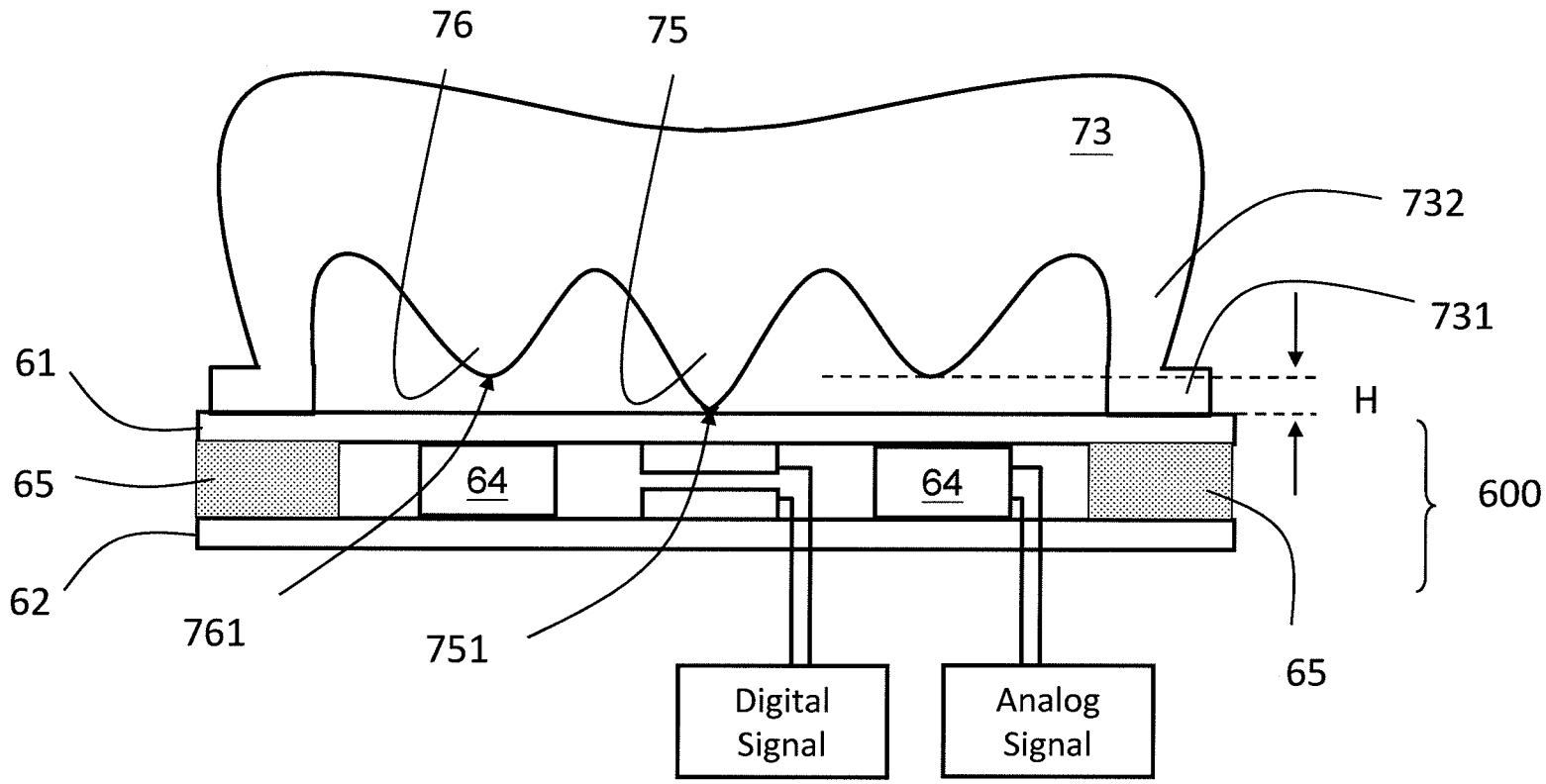
FIG. 11 is a second rubber dome button according to the present invention.

FIG. 11 is a second rubber dome button according to the present invention.

FIG. 11 shows that a second rubber button 73 is devised according to the present invention. The second rubber button 73 has a base rubber ring 731 on a bottom; a circular wall 732 is configured on a top of the base rubber ring 731; a downward central bump 75 is configured under a bottom center of the rubber button 73; a downward bump ring 76 is configured under the bottom of the button 73, and is configured concentrically with the downward central bump 75; and a bottom tip 751 of the downward central bump 75 is configured in a position below a bottom tip 761 of the downward bump ring 76, please refer to the difference H between tip 751 and tip 761. The downward central bump 75 can be restorably deformed to apply a first pressure on the top substrate 61 against the top electrode 631; the downward bump ring 76 is configured concentrically with the downward central bump 75; and the downward bump ring 76 is able to apply a second pressure on the top substrate 61 against the pressure sensor ring 64.

Figures 12A, 12B:
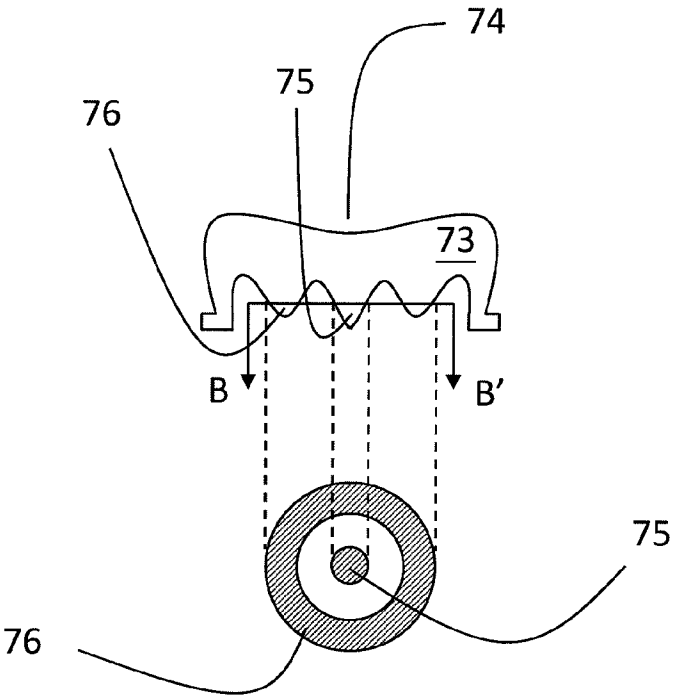

FIGS. 12A~12B are section views of the second rubber dome button according to the present invention.

FIG. 12A shows a vertical section view of the second rubber dome button 73 according to the present invention. The downward central bump 75 is configured in the bottom center and the downward bump ring 76 is concentrically arranged with reference to the downward central bump 75. FIG. 12B shows a horizontal section view along line BB' of the second rubber dome button 73 to show that the downward bump ring 76 is arranged to surround the downward central bump 75.

Figure 13:
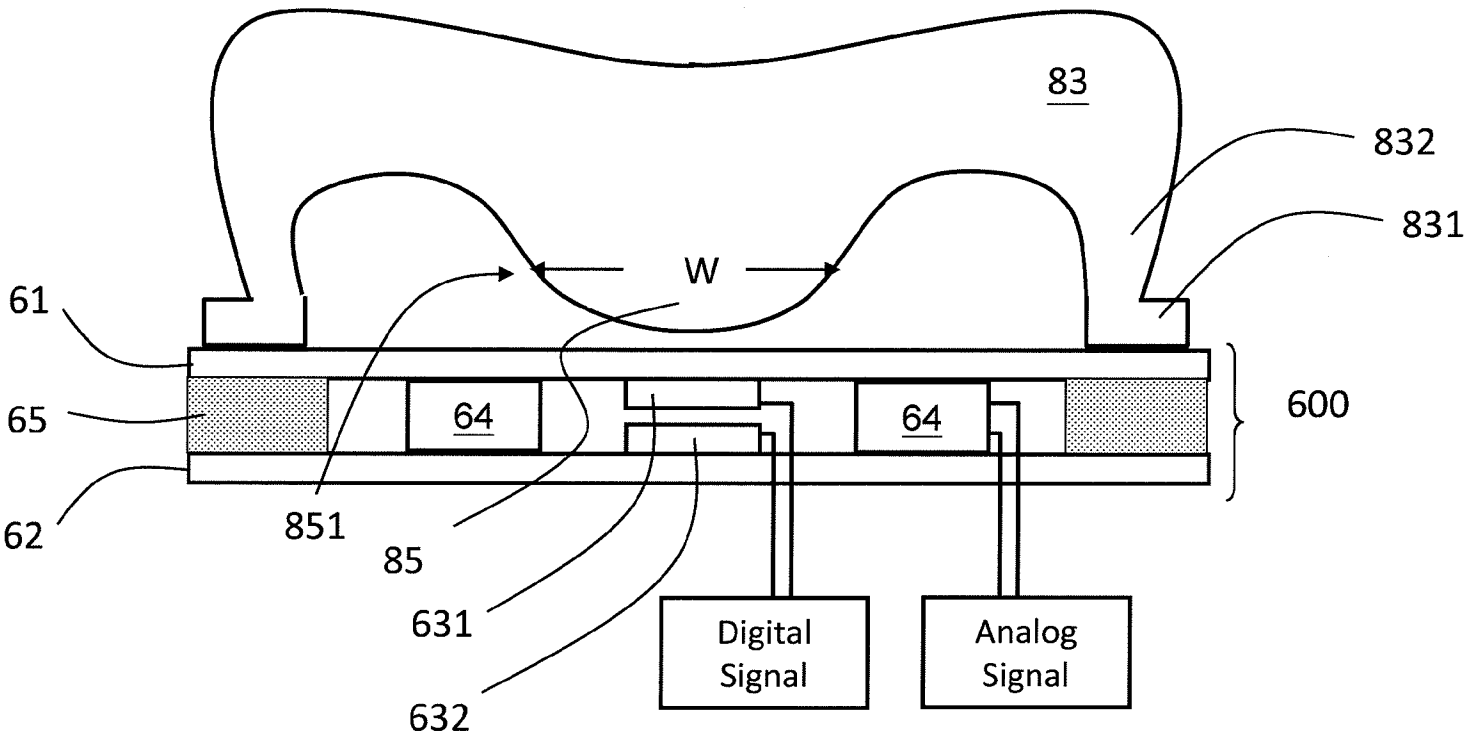
FIG. 13 is a third rubber dome button according to the present invention

FIG. 13 is a third rubber dome button according to the present invention

FIG. 13 shows that a third rubber button 83 is devised. The third rubber button 83 has a base rubber ring 831 on a bottom; a circular wall 832 is configured on a top of the base rubber ring 831; a downward central bump 85 has a fatter waist 851 which has a width W or a section area in middle latitude larger than a width or a top surface area of the electrode 631. The downward central bump 85 is configured under a bottom center of the rubber button 83. The downward central bump 85 is able to be restorably depressed to apply a first pressure on the top substrate 61 against the top electrode 631.

Figure 14:
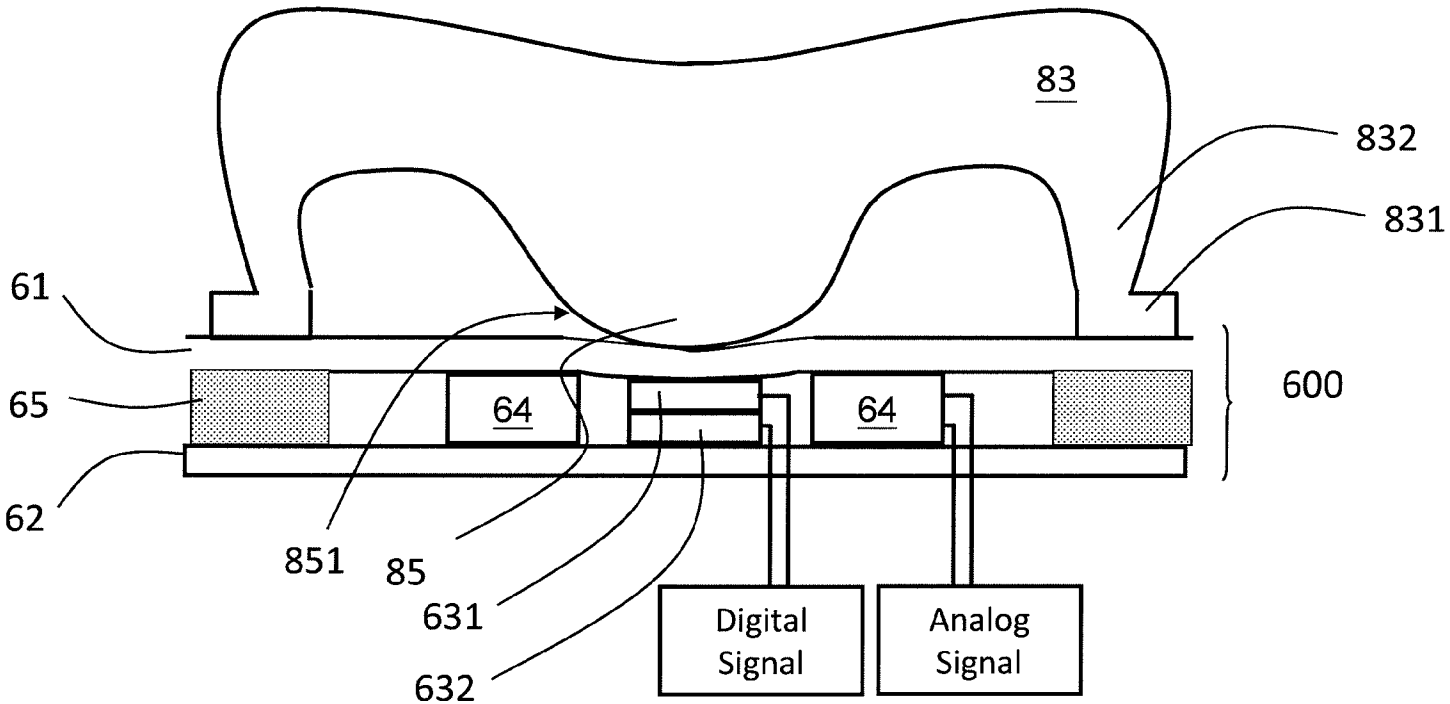
FIG. 14 shows digital signal output for the third rubber dome button

FIG. 14 shows digital signal output for the third rubber dome button

FIG. 14 shows when the downward central bump 85 applies a first pressure on the top substrate 61 against the top electrode 631 to cause the top electrode 631 contacting the bottom electrode 632, a digital signal shall output. At this moment, only a little sag in the center of the top substrate 61, no pressure is transmitted against the pressure sensor ring 64, and therefore no analog signal shall output.

Figure 15:
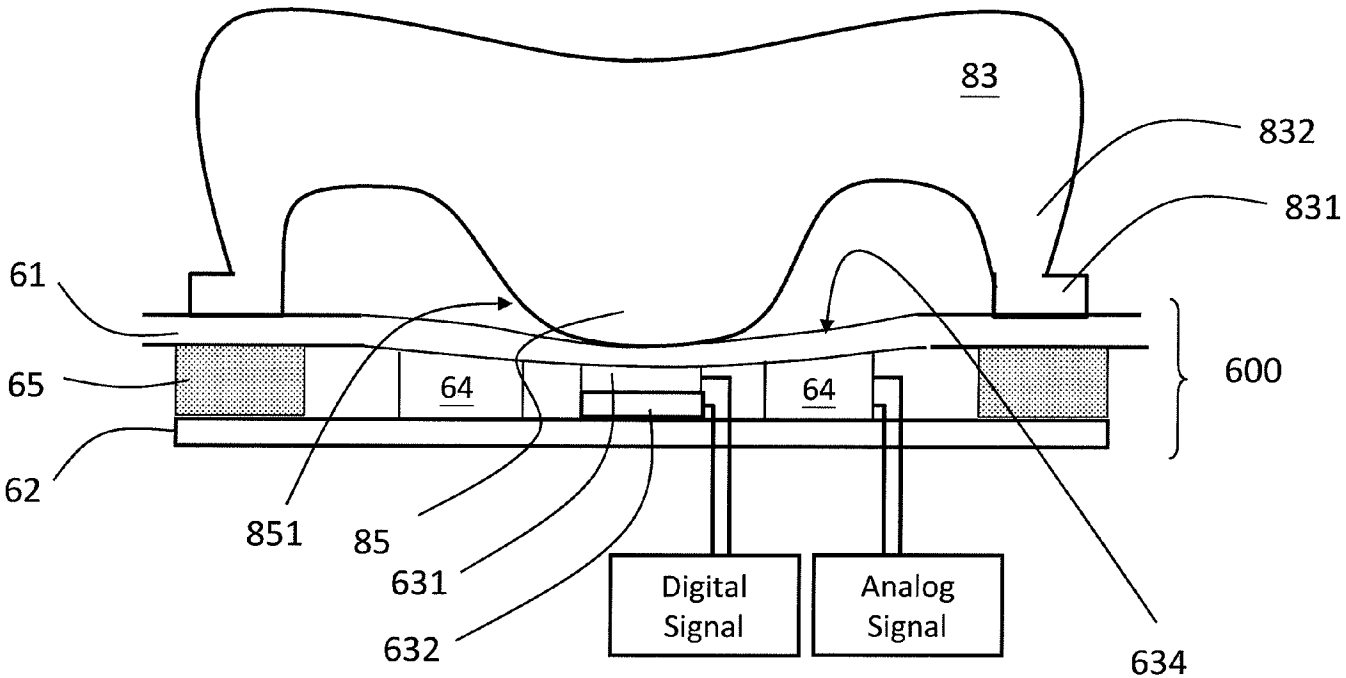
FIG. 15 show analog signal output according to the present invention

FIG. 15 show analog signal output according to the present invention

FIG. 15 shows after the first pressure is applied on the top substrate 61, to depress the central button 53 further, the elastic bulky chunk of the fat downward central bump 85 causes a bigger sag of the top substrate 61. The bigger sag shall apply a second pressure on the top substrate 61 against the pressure sensor ring 64 to cause an analog signal to output. In other words, the downward central bump 85 is able to apply an inclined pressure 634 on the top substrate 61 against the pressure sensor ring 64 after the rubber button 83 is depressed further. The second pressure is at least partially generated by the central sag of the top substrate 61, and the central sag is caused by a pressure of the bulky chunk of the downward central bump 85.

Figure 16A:
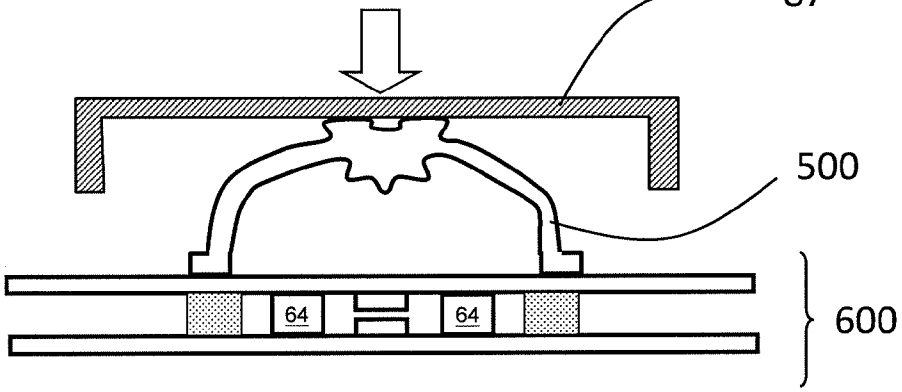
FIGS. 16A~16B show a plastic cap is configured on a top of the rubber dome button
Figure 16B:
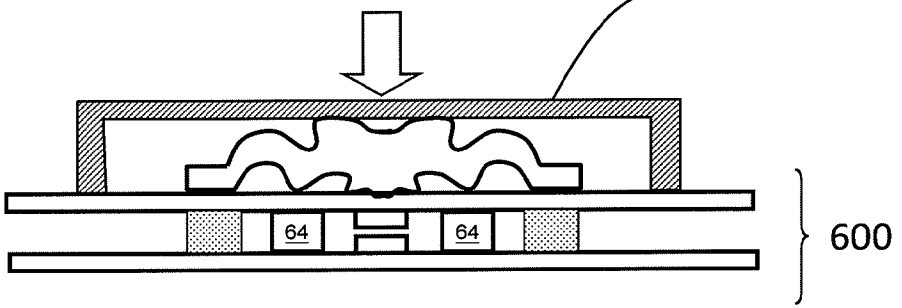

FIGS. 16A~16B show a plastic cap is configured on a top of the rubber dome button FIG. 16A shows a plastic cap 87, like the one seen on a key board, is configured on a top of the rubber dome button 500 adapted for being depressed by a user's hand. FIG. 16B shows a status that the plastic cap 87 is depressed.

While several embodiments have been described by way of example, it will be apparent to those skilled in the art that various modifications may be configured without departing from the spirit of the present invention. Such modifications are all within the scope of the present invention, as defined by the appended claims.

What is claimed is:

1. A pressure key, comprising:
a circuit base, further comprising:
a top substrate;
a bottom substrate;
a top electrode, configured under a bottom surface of the top substrate;
a bottom electrode, aligned with the top electrode, configured on a top surface of the bottom substrate;
a gap, configured between the top electrode and the bottom electrode; and
a pressure sensor ring, configured between the top substrate and the bottom substrate, and configured concentrically with the top electrode.

2. A pressure key as claimed in claim 1, wherein
the top substrate is flexible;
a digital signal is able to output when the top electrode contacts the bottom electrode; and
an analog signal is able to output when the pressure sensor ring is depressed.

3. A pressure key as claimed in claim 1, further comprising:
a rubber dome button, configured on a top surface of the circuit base, which further comprising:
a base rubber ring;
a dome, configured on a top of the base rubber ring;
a central button, configured on a top center of the dome;
a downward central bump, configured under a bottom center of the rubber button.

4. A pressure key as claimed in claim 3, wherein
the downward central bump is restorably depressed to apply a first pressure on the top substrate against the top electrode; and
a downward crack bump ring is formed temporarily, and configured concentrically with the downward central bump when the central button is depressed to a degree; wherein
a bottom tip of the downward crack bump ring initially having a position above a bottom tip of the downward central bump;
the downward crack bump ring is able to apply a second pressure on the top substrate against the pressure sensor ring when the central button is depressed further.

5. A pressure key as claimed in claim 1, further comprising:
a spacer ring, aligned with the base rubber ring, configured concentrically with the top electrode, and configured between the top substrate and the bottom substrate.

6. A pressure key as claimed in claim 1, further comprising:
a gap, formed in the top substrate, configured in a position above the spacer ring, and configured along an inner side of the spacer ring.

7. A pressure key as claimed in claim 6, wherein the arc gap is a quarter arc gap.

8. A pressure key as claimed in claim 1, further comprising:
four quarter arc gaps, formed in the top substrate, configured in a position above the spacer ring, and configured along an inner side of the spacer ring.

9. A pressure key as claimed in claim 3, further comprising:
a recess, configured on a top center of the central button.

10. A pressure key as claimed in claim 3, further comprising:
a upward bump, configured on a top center of the central button.

11. A pressure key as claimed in claim 1, further comprising:
a rubber button, configured on a top surface of the circuit base, which further comprising:
a base rubber ring;
a circular wall configured on a top of the base rubber ring;
a downward central bump, configured under a bottom center of the rubber button;
a downward bump ring, configured under the bottom of the button, and configured concentrically with the downward central bump; and
a bottom tip of the downward central bump is configured in a position below a bottom tip of the downward bump ring.

12. A pressure key as claimed in claim 11, wherein
the downward central bump is restorably depressed to apply a first pressure on the top substrate against the top electrode; and
the downward bump ring is configured concentrically with the downward central bump; and
the downward bump ring is able to apply a second pressure on the top substrate against the pressure sensor ring.

13. A pressure key as claimed in claim 11, further comprising:
a spacer ring, configured concentrically with the top electrode, and configured between the top substrate and the bottom substrate.

14. A pressure key as claimed in claim 11, further comprising:
a gap, formed in the top substrate, configured in a position above the spacer ring, and configured along an inner side of the spacer ring.

15. A pressure key as claimed in claim 14, wherein the arc gap is a quarter arc gap.

16. A pressure key as claimed in claim 11, further comprising:
four quarter arc gaps, formed in the top substrate, configured in a position above the spacer ring, and configured along an inner side of the spacer ring.

17. A pressure key as claimed in claim 11, further comprising:
a recess, configured on a top center of the rubber button.

18. A pressure key as claimed in claim 1, further comprising:
a rubber button, configured on a top surface of the circuit base, which further comprising:
a base rubber ring;
a circular wall configured on a top of the base rubber ring;

a downward central bump, having a width in a middle latitude larger than a width of the electrode, configured under a bottom center of the rubber button.

19. A pressure key as claimed in claim 18, wherein the downward central bump is restorably depressed to apply a first pressure on the top substrate against the top electrode; and the downward central bump is able to apply a second pressure to form a central sag on the top substrate by a deformed bulky chunk; wherein the sag applies a inclined pressure against the pressure sensor ring.

20. A pressure key as claimed in claim 18, further comprising:

a spacer ring, configured concentrically with the top electrode, and configured between the top substrate and the bottom substrate.

21. A pressure key as claimed in claim 18, further comprising:

a gap, formed in the top substrate, configured in a position above the spacer ring, and configured along an inner side of the spacer ring.

22. A pressure key as claimed in claim 19, wherein the arc gap is a quarter arc gap.

23. A pressure key as claimed in claim 18, further comprising:

four quarter arc gaps, formed in the top substrate, configured in a position above the spacer ring, and configured along an inner side of the spacer ring.

24. A pressure key as claimed in claim 3, further comprising:

a plastic cap, configured on a top of the rubber dome button.

* * * * *